US005334483A

United States Patent [19]

Baker et al.

[11] Patent Number: 5,334,483

[45] Date of Patent: Aug. 2, 1994

[54] DIFFUSION TRANSFER RECEIVER

[75] Inventors: Julie Baker, Rickmansworth; Colin J. Gray, Harrow; Anthony M. Barnett, Bushey, all of United Kingdom

[73] Assignee: Eastman Kodak Company, Rochester, N.Y.

[21] Appl. No.: 39,329

[22] Filed: Apr. 26, 1993

[30] Foreign Application Priority Data

Nov. 21, 1990 [GB] United Kingdom ..... 9025365.9

[51] Int. Cl.[5] ..... G03C 5/54

[52] U.S. Cl. ..... 430/207; 430/227; 430/231; 430/233

[58] Field of Search ..... 430/227, 231, 232, 248, 430/233, 207

[56] References Cited

U.S. PATENT DOCUMENTS

| | | | |
|---|---|---|---|
| 3,518,160 | 6/1970 | Beavers et al. | 430/231 |
| 4,401,753 | 4/1983 | Vaes et al. | 430/230 |
| 4,808,509 | 2/1989 | Vervlogt et al. | 430/248 |
| 4,859,565 | 8/1989 | Dekoyzer et al. | 430/231 |
| 5,043,246 | 3/1991 | Barnett et al. | 430/233 |

FOREIGN PATENT DOCUMENTS 0397925 7/1990 European Pat. Off. .

*Primary Examiner*—Richard L. Schilling
*Attorney, Agent, or Firm*—Alfred P. Lorenzo

[57] ABSTRACT

The invention provides a diffusion transfer receiver comprising a support with a non-light-sensitive image receiving layer coated onto each face thereof, said image receiving layer in each case comprising a catalytic nuclei layer for physical development of transferred complexed silver halide and each composite comprising a diffusion modifying active component which is preferably a tone controlling compound. The composites of Side 1 and Side 2 are different constitutions so as to provide receivers suitable for different end users. For example Side 1 can be made suitable for creative designers while Side 2 can be made suitable for pre-sensitized plate-makers.

The invention also provides a method for improving transmission density of a receiver sheet in a non-light-sensitive image receiving layer of a silver diffusion transfer process which method comprises utilizing in the receiver layer an S-thiuronium alkyl sulfonate transmission density enhancer.

8 Claims, 3 Drawing Sheets

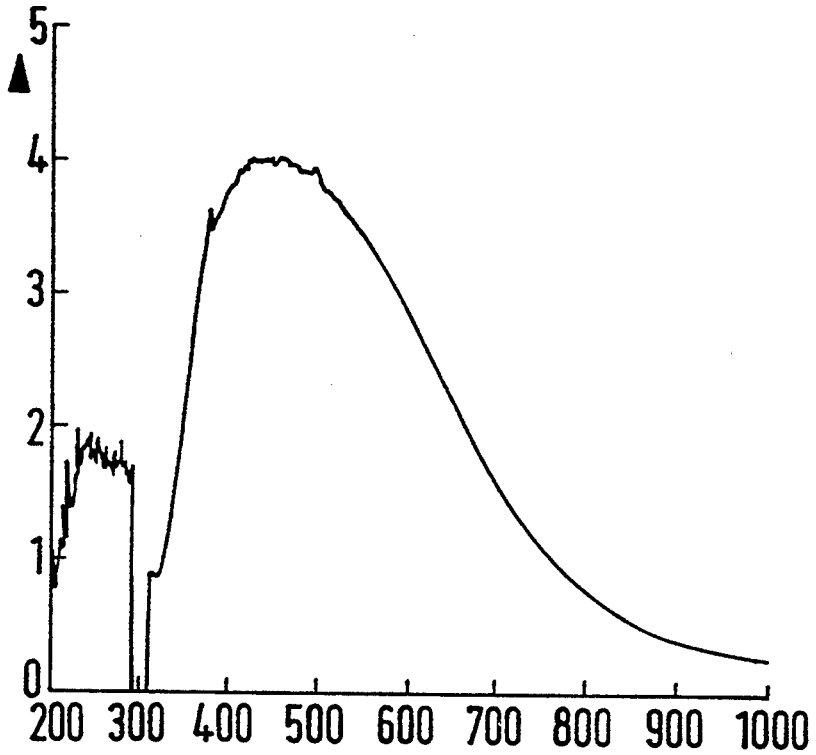
Fig. 2 Spectrophotometer trace of the absorption of side 1 of S92257.
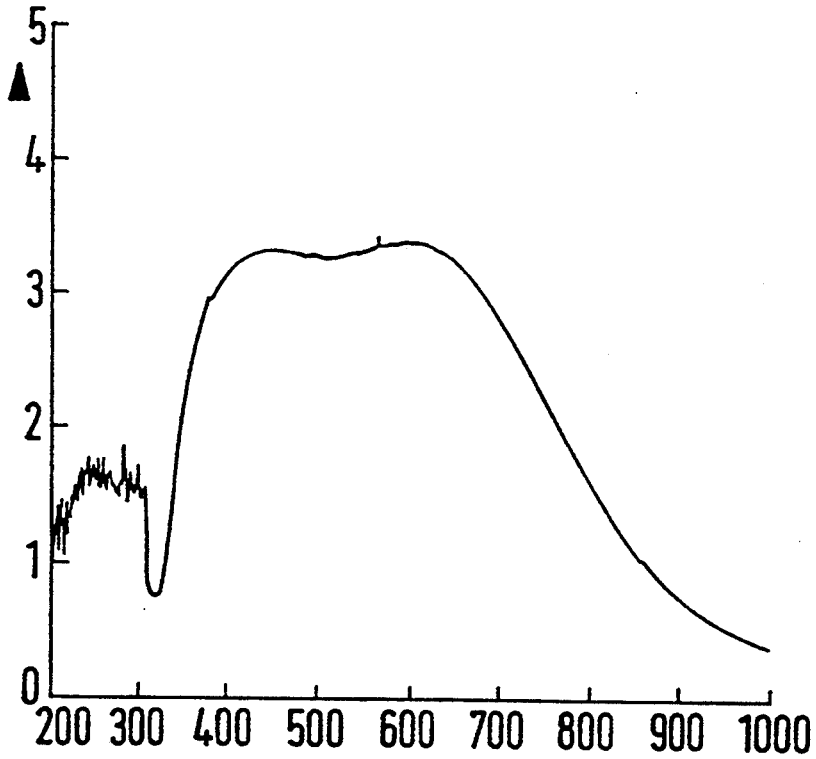
Fig. 3 Spectrophotometer trace of the absorption of side 2 of S92257.

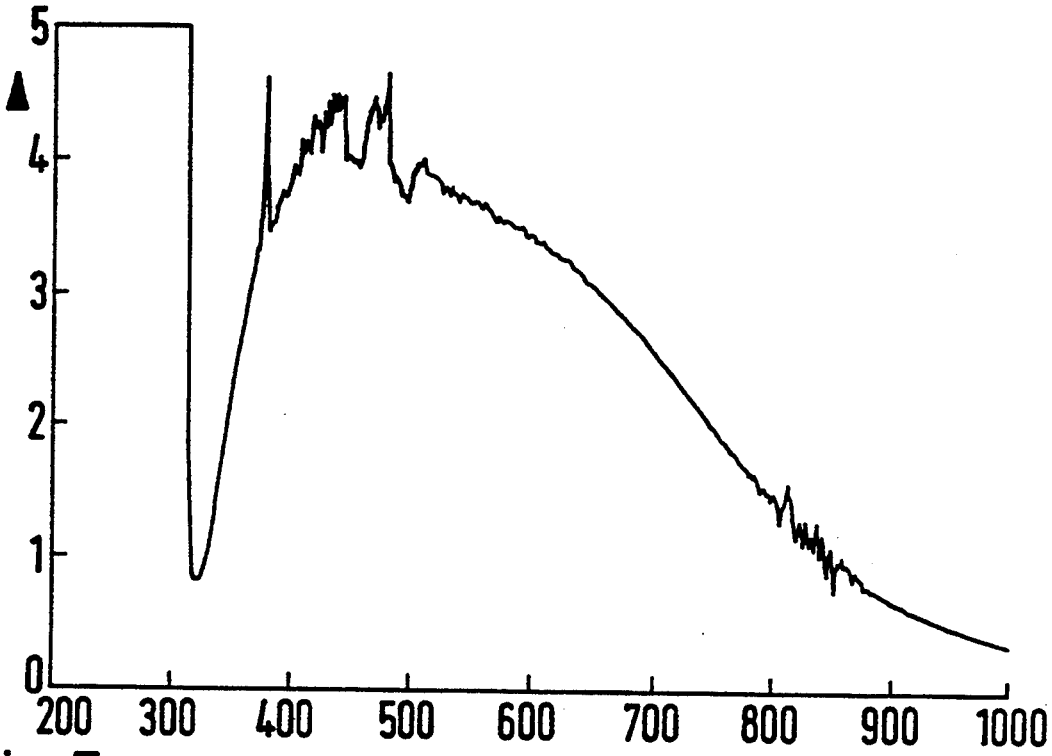
Fig.5 Spectrophotometric trace of D-max region from A.
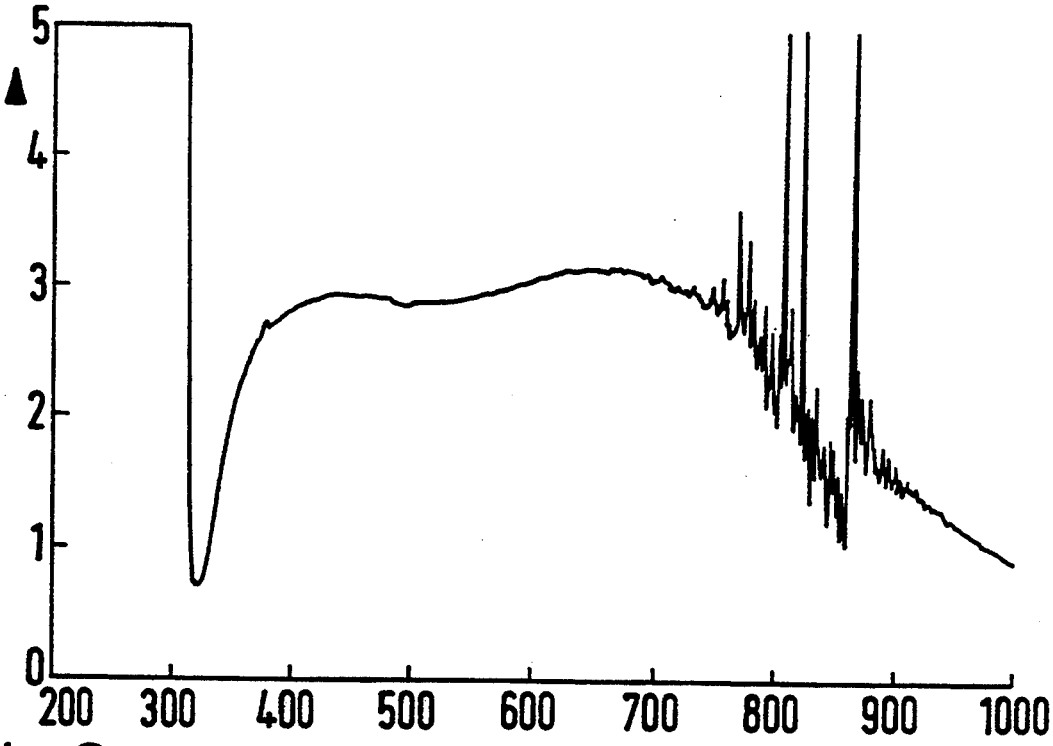
Fig.6 Spectrophotometric trace of D-max region from B.

DIFFUSION TRANSFER RECEIVER

FIELD OF THE INVENTION

The present invention relates to a diffusion transfer receiver coated on a support base which makes use of the different properties of diffusion modifying active components such as tone controlling compounds to give a receiver with two faces each of which is suitable for a different end use, for example for creative designers or for presensitized plate-makers.

BACKGROUND OF THE INVENTION

In the hitherto used silver complex diffusion-transfer reversal process, a negative working silver halide emulsion material is image-wise exposed to give a latent image. This exposed material is chemically developed by means of a silver halide developing agent reducing the exposed silver halide, usually in the presence of a silver halide complexing agent for example sodium thiosylfate.

Thereupon the developed material is brought into contact with an image receiving material containing catalytic nuclei for physical development of transferred complexed silver halide.

The transferred complexed non-developed silver halide of the negative material is thereby physically developed on the nuclei by the action of developing agent in alkaline medium to form a silver image. This process is well known in the art.

Tone controlling compounds are used in this process in the image-receiving layers of diffusion transfer receivers to control the tone of the positive image. Many examples are reviewed in the literature for example A. Rott and E. Weyde "Photographic Silver Halide Diffusion Processes", The Focal Press, London and New York 1972, page 61.

Tone controlling compounds can be used on their own or in combination with other toners in the same or adjacent layers.

Conventionally diffusion transfer film receivers have the same layers coated on each side of the base such that identical results are obtained irrespective of which side is laminated with a diffusion transfer donor in a diffusion transfer process.

Two main uses of film receivers of this type require somewhat different properties. Creative design work is best served by a neutral or near neutral image color from the physically developed silver. Further the absence of bronzing is desirable so that the image looks black from whichever side of the film the image is viewed.

However in presensitized plate-making work it is important that the silver image has high blue and UV opacity because the exposing sources in the plate-making step are usually in the UV spectrum; typically "diazo" type lamps with maximum output at 410 nm and "polymer" type lamps with maximum output at 365 nm. If these silver images have high density in the blue and UV it is not necessary for an equivalent density in other parts of the spectrum. Thus red-brown or brown image color may be preferred if it results in high absorption in the blue and UV and low absorption in the red. Also, because in this application the receiver is merely being used as an intermediate it is of little consequence if the image is bronzed.

In U.S. Pat. No. 4,401,753 there is disclosed a photographic material containing a transparent support coated at each side with a negative working hydrophilic colloid silver halide emulsion layer. This arrangement gives a physically developed positive print by diffusion transfer of sufficient density to be used as an internegative.

SUMMARY OF THE INVENTION

In contradistinction the present invention provides a diffusion transfer receiver comprising a support layer, a non-light-sensitive image receiving layer coated onto each face of the support layer, said image receiving layer including catalytic nuclei for physical development of transferred complexed silver halide, and a diffusion modifying active component, characterised in that the active components of each image receiving layer differ to provide a diffusion transfer receiving layer adapted for a different end use.

In a preferred form of the invention the diffusion modifying active component is a tone controlling compound which may differ for each layer thereby to provide a different D-max transferred silver transmission density over the spectrum for each image receiving layer.

The tone controlling compounds selected for use in the first layer may give a relatively low transmission density in the visual range and a relatively higher transmission density in the UV and blue range compared to the result given by tone controlling compounds in the second layer.

BRIEF DESCRIPTION OF THE DRAWINGS

FIG. 2 shows a spectrophotometer trace of the absorption of Side 1 of the receiver in accordance with the example, FIG. 3 shows a spectrophotometer trace of the absorption of Side 2 of the receiver in accordance with the example, FIG. 5 shows a spectrophotometer trace of the D-max region of a receiving layer including 3-S-thiuronium propane sulfonate, and FIG. 6 shows a spectrophotometer trace of the D-max region of a receiver layer with a conventional tone controlling compound therein.

DESCRIPTION OF THE PREFERRED EMBODIMENTS

Figure 1:
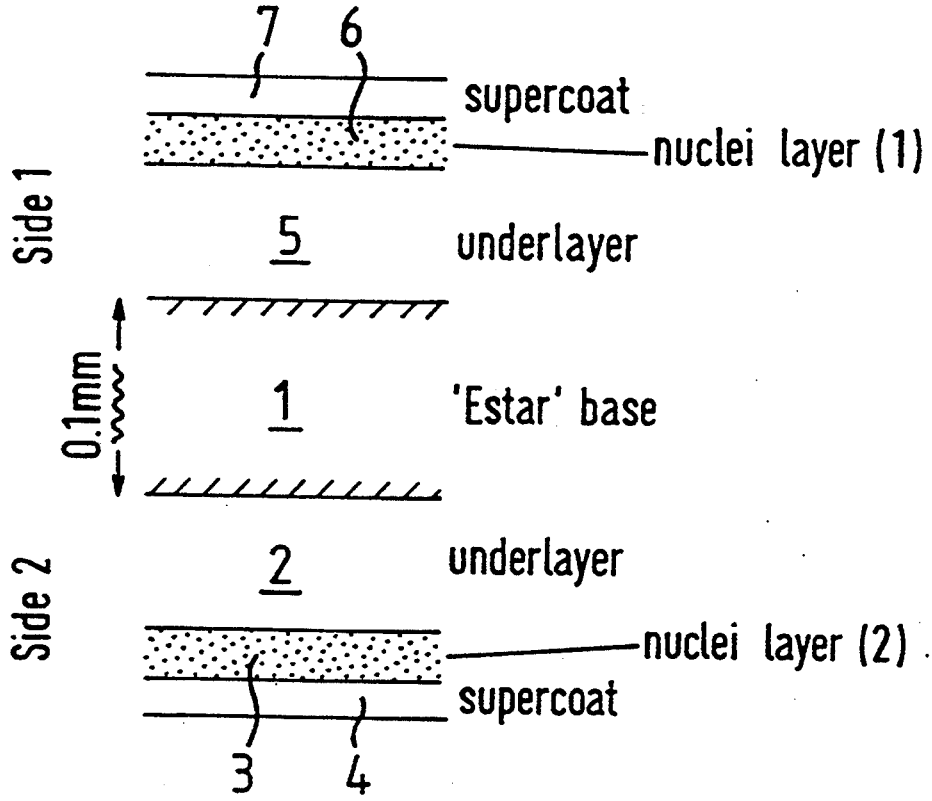
FIG. 1 shows in diagrammatic form an image receiving diffusion transfer material.

The support layer is preferably a clear photographic base for example formed of Estar or an acetate, said base being overlayed on each side by a three layer composite, each composite including an underlayer comprising gelatin and a second tone controlling compound, a nuclei layer comprising nickel sulphide modified by an addition of silver iodide, and a first tone controlling compound, and a gelatin supercoat layer. The underlayer may include a hardening agent and the superlayer may include a surfactant.

The first tone controlling compound in the underlayer may be 2-phenyl-5-mercapto-oxadiazole whereas the tone controlling compound of the nuclei layer may be 3-S-thiuronium propane sulfonate or 5-methylbenzotriazole.

Thus in the preferred form of the invention the non-light-sensitive image receiving layers are each coated onto a respective side of clear Estar support thereby to provide layers with properties suitable for creative design work for example artwork, overlays, overhead projection transparencies and flexible "wrap-arounds" in conjunction with a non-light sensitive image receiving layer coated on the other side of the support which has properties suitable for positive presensitized plate-making applications.

The receivers in accordance with the present invention utilize the custom and practice of coating layers on both sides of the base and therefore there is no significant increase in costs by adopting the arrangement of the present invention.

It will be noted that while the invention has been generally described in terms of the tone controlling compounds, other means of modifying the tone and density can be used either in addition to or instead of the tone controlling compounds.

The image receiving layers in accordance with the present invention can differ for example in the amount of tone controlling compound or diffusion modifying active component laydown and their relative position where a plurality of layers are utilized. Similarly the catalytic nuclei laydowns and position in the composite can change as can the order of layers, the number of layers, and position and presence of hardeners and surfactants.

In a preferred form of the invention the different sides of the receiver may be identified by use of a visual mark to indicate which side is suitable for which use. Alternatively the different sides may be identified by use of a different matting agent on each side allowing recognition by touch.

Suitable hardening agents for use in the present invention include BVSME, BVSM, or formaldehyde. It will be appreciated that the support layer can be varied in thickness and is preferably clear.

In a further feature of the present invention we have found that the utilization of the S-thiuronium alkyl sulfonates such as 3-S-thiuronium propane sulfonate improves the transmission densities of image receiving sheets particularly in the blue and UV region of the spectrum. This makes these particularly suitable for production of intermediates used in making presensitized printing plates.

In our European Patent Application No. 0 398 750 we have claimed novel thiuronium alkyl sulfonates as tone controlling compounds which accelerate the physical development of silver. We have now found that these compounds have other desirable properties especially in the field of presensitized printing plates.

In accordance therefore with another aspect of the present invention there is provided a method of improving the transmission density in the blue and UV spectrum of a receiver layer in a non-light-sensitive image receiving sheet used in a silver halide diffusion transfer process, which method comprises utilizing in a receiver layer, an S-thiuronium alkyl sulfonate as a transmission density improver.

The S-thiuronium alkyl sulfonates in accordance with the present invention may have the general formula as follows:

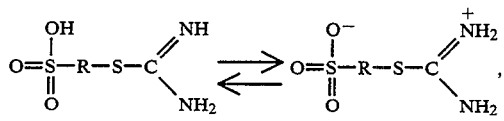

(1)

wherein R is a $C_1$–$C_6$ linear or branched, substituted or unsubstituted, alkylene group.

A particularly preferred compound is the 3-S-thiuronium propane sulfonate of the formula:

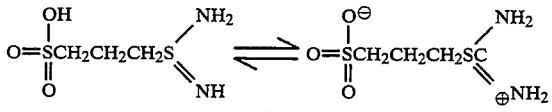

I

These thiuronium compounds of the invention are also useful in combination with other tone controlling compounds; both the novel compounds revealed in EP-A-0 398 750 and other conventional compounds.

In the receiving layers in accordance with this aspect of the invention it is preferred that the spectrophotometric absorption at 410 nm is in excess of 3.50 and most preferably in excess of 4.00 and wherein the absorption at 365 run is in excess of 2.75 and preferably in excess of 3.00. Preferably the transmission density is about 3.50.

The photographic elements of this invention or individual layers thereof, can contain brighteners (see Research Disclosure Section V), antifoggants and stabilisers (see Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section X), plasticisers and lubricants (see Research Disclosure Section XII), antistatic agents (see Research Disclosure Section XIII), matting agents (see Research Disclosure Section XVI), and development modifiers (see Research Disclosure Section XXI).

The photographic elements can be coated on a variety of supports as described in Research Disclosure Section XVII and the references described therein, for example on a paper or transparent film base.

The invention will now be described by way of illustration only with reference to the accompanying drawings and to the subsequent Examples.

With reference to FIG. 1 a support layer 1 formed of a clear photographic material; for example Estar base, having a thickness of 0.1 nm is overlayed by a composite on each face thereof. The composite of Side 2 comprises an underlayer 2 a nuclei layer 3 and a supercoat 4. Similarly the composite of Side 1 comprises an underlayer 5, a nuclei layer 6 and a supercoat 7. The purposes of these layers will be described below with reference to the Examples.

Figure 4:
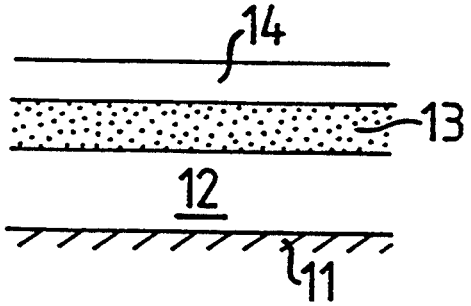
FIG. 4 shows in diagrammatic form an image-receiving diffusion transfer material.

Similarly with regard to FIG. 4 a base layer 11 formed of a clear photographic material for example an Estar base, having a thickness of about 0.1 mm is overlayed by a composite on a single face thereof.

The composite so formed comprises an underlayer 12, a nuclei layer 13 and a supercoat 14.

The arrangments of FIGS. 5 and 6 are discussed later.

Examples of the invention will now be described by way of illustration.

EXAMPLE 1

Side 1 of an Estar base material was coated with three layers. A supercoat consisting of gelatin at a laydown of 0.39 g/m$^2$, was caused to overlay a nuclei layer containing nickel sulfide nuclei modified by the addition of silver iodide. The nickel sulfide laydown was 1.92 mg/m$^2$ and the respective gelatin laydown was 0.54 g/m$^2$.

A tone controlling compound 3-S-thiuronium propane sulfonate was included in this nuclei layer at a laydown of 66.9 mg/m$^2$.

This nuclei layer overlay an underlayer consisting of gelatin at a laydown of 1.38 g/m$^2$ and a second tone controlling compound, 2-phenyl-5-mercapto-oxadiazole at a laydown of 3.6 mg/m$^2$. During coating a hardening agent (BVSME) was added to the underlayer and a surfactant was added to the supercoat.

Immediately after Side 1 had been set and dried, the base was reversed and Side 2 was again coated with three layers. The supercoat consisted of gelatin at a laydown of 0.39 g/m$^2$, the nuclei layer contained nickel sulfide nuclei modified by the addition of silver iodide. The nickel sulfide laydown was 1.92 mg/m$^2$ and the gelatin laydown was 0.54 g/m$^2$.

A tone controlling compound, 5-methylbenzotriazole, was included in this nuclei layer at a laydown of 66.9 mg/m$^2$. The underlayer consisted of gelatin at 1.38 g/m$^2$ and a second tone controlling compound, 2-phenyl-5-mercapto-oxadiazole at 3.6 mg/m$^2$ was added. During coating a hardening agent (BVSME) was added to the underlayer and a surfactant was added to the supercoat.

Throughout the total coating operation the support used was a 0.1 mm thick Estar base which had been gelatin subbed on both sides. Upon completion of the total coating and drying operations a reference number, S92257, was punched on each sheet of receiver such that the number could be read when Side 1 faced the user but appeared reversed when Side 2 faced the user.

It will be noted that Sides 1 and 2 differ in the choice of tone controlling compound in the nuclei layer.

Strips of a light-sensitive PMT II Negative Film SO-580 were exposed to a test object on a graphic arts camera and processed with the image receiver such that an example was made when Side 1 of the receiver was laminated with the donor and another example when Side 2 was laminated with the donor. A Kodak "Imagemate" 43DT processor containing Kodak PMT II Activator was used for processing. After 60 seconds lamination the diffusion transfer sandwich was stripped apart and the fill receiver coatings washed and dried.

Areas of the receivers containing D-max transferred silver were measured on an X-rite densitometer for Visual (V), Blue (B), Green (G) and Red (R) transmission density (DT), and the data recorded and R-G, G-B differences calculated (Table 1).

TABLE 1

| | Image Receiver | | | | | |
|---|---|---|---|---|---|---|
| S92257 | V DT | B DT | G DT | R DT | R-G | G-B |
| Side 1 | 3.04 | 4.34 | 3.62 | 2.53 | −1.09 | −0.72 |
| Side 2 | 3.20 | 3.18 | 3.15 | 3.22 | +0.07 | −0.03 |

Although in this example Side 1 of S92257 had a lower visual transmission density, it had a higher green (+0.47) and significantly higher blue (+1.16) density than Side 2. Side 2 had approximately equal transmission densities for all four channels. The difference between the two sides of S92257 was emphasised by measuring the absorption, between 1000 and 200 nm, in a spectrophotometer (FIGS. 2 and 3). The absorption at 410 and 365 nm was noted and recorded (Table 2).

TABLE 2

| | Image Receiver | |
|---|---|---|
| S92257 | Absorption, 410 nm | Absorption, 365 nm |
| Side 1 | 3.88 | 3.01 |
| Side 2 | 3.22 | 2.65 |

Thus, Side 2 of the receiver of the invention has properties suited for creative designers, and Side 1 of the receiver has properties suited for an intermediate when making printing plates from presensitized plates.

EXAMPLE 2

With reference to FIG. 4 the supercoat laydown consisted of gelatin at 0.39 g/m$^2$.

The nuclei layer contained nickel sulfide nuclei modified by the addition of silver iodide. NiS laydown was 1.92 mg/m$^2$ and the gelatin laydown was 0.54 g/m$^2$. The tone controlling compound of the invention, 3-S-thiuronium propane sulfonate, was included in this layer at a laydown of 66.9 mg/m$^2$. The underlayer consisted of gelatin at 1.38 g/m$^2$ and a second toner of the prior art; 2-phenyl-5-mercapto-oxadiazole at 3.6 mg/m$^2$.

The support for base 11 was a gelatin subbed "Estar" base at 0.10 mm thick. During coating a hardening agent, formaldehyde, was added to the underlayer and a surfactant was added to the supercoat.

A comparison coating was applied immediately afterwards and assigned the reference B. It had the same coating details as for the previous coating (assigned the designation A) except that the 3-S-thiuronium propane sulfonate was replaced with a toner of the prior art namely 5-methylbenzotriazole at the same laydown (i.e. 66.9 mg/m$^2$).

Strips of PMT II Negative Film SO-580 were exposed to a test object on a graphic arts camera and processed with layers A and B through a diffusion transfer processor containing suitable activiator (PMTII). After 60 seconds lamination the diffusion transfer sandwich was stripped apart and the film receiver coatings washed and dried.

Areas of the receivers containing D-max transferred silver were measured in the spectrophotometer between 1000 and 200 nm (FIGS. 5 and 6) and the absorption at 410 and 365 nm were recorded (Table 3 below). The visual transmission density (DT) was also noted.

TABLE 3

| Coating | Nuclei layer toner | DT | A (410 nm) | A (365 nm) |
|---|---|---|---|---|
| A | 3-S-thiuronium propane Sulfonate | 3.50 | 4.16 | 3.05 |
| B | 5-methylbenzotriazole | 3.15 | 2.86 | 2.47 |

The results show that the use of the compound of the invention results in a diffusion transfer film receiver with improved blue and UV absorption.

We claim:

1. A diffusion transfer receiver for use in a diffusion transfer photographic process, said diffusion transfer receiver comprising a support and non-light-sensitive image receiver layers exhibiting different imaging characteristics which adapt them for different end uses on each face of said support, each of said image receiver layers including catalytic nuclei for physical development of a transferred silver halide complex and containing different tone controlling compounds to impart said different imaging characteristics thereto.

2. A diffusion transfer receiver as claimed in claim 1, wherein the sides of the receiver are identifiable by a visual mark indicating which side is suitable for which use.

3. A diffusion transfer receiver as claimed in claim 1, wherein the sides of the receiver are identifiable by a different matting agent on each side to allow recognition by touch.

4. A diffusion transfer receiver as claimed in claim 1, wherein said catalyst nuclei comprise nickel sulfide modified by the addition of silver iodide.

5. A diffusion transfer receiver as claimed in claim 1, wherein a tone controlling compound in a first image receiver layer provides a lower transmission density in the visual range and a higher transmission density in the blue and UV range than a tone controlling compound in the second image receiver layer.

6. A diffusion transfer receiver as claimed in claim 1, having on each face of said support an underlayer comprising gelatin and a tone controlling compound, a nuclei layer comprising nickel sulfide modified by the addition of silver iodide and a tone controlling compound, and a supercoat layer comprising gelatin.

7. A diffusion transfer receiver as claimed in claim 6, wherein each said underlayer includes a hardening agent and each said supercoat layer includes a surfactant.

8. A diffusion transfer receiver as claimed in claim 6, wherein the tone controlling compound in each said underlayer is 2-phenyl-5-mercaptooxadiazole and the tone controlling compound in each said nuclei layer is 3-S-thiuronium propane sulfonate or 5-methylbenzotriazole.

* * * * *